United States Patent [19]

Brown

[11] 4,283,892

[45] Aug. 18, 1981

[54] METAL CONSTRUCTION STUD AND WALL SYSTEM INCORPORATING THE SAME

[75] Inventor: Larry B. Brown, Richmond, Va.

[73] Assignee: Reynolds Metals Company, Richmond, Va.

[21] Appl. No.: 137,734

[22] Filed: Apr. 7, 1980

Related U.S. Application Data

[63] Continuation of Ser. No. 930,392, Aug. 2, 1978.

[51] Int. Cl.[3] ..... E06B 1/06; E04B 2/72

[52] U.S. Cl. ..... 52/213; 52/241; 52/281; 52/481; 52/738

[58] Field of Search ..... 52/281, 273, 241, 242, 52/481, 738, 213

[56] References Cited

U.S. PATENT DOCUMENTS

| | | | |
|---|---|---|---|
| 3,010,547 | 11/1961 | Foster | 52/281 |
| 3,222,836 | 12/1965 | Collin et al. | 52/281 |
| 3,702,044 | 11/1972 | Balinski | 52/481 |
| 4,080,766 | 3/1978 | Jastrabek | 52/242 |

FOREIGN PATENT DOCUMENTS

| | | | |
|---|---|---|---|
| 149361 | 12/1952 | Australia | 52/481 |
| 2355658 | 5/1975 | Fed. Rep. of Germany | 52/241 |
| 642051 | 7/1962 | Italy | 52/241 |

OTHER PUBLICATIONS

Blueprint Drawing Nos. 44515968, 44515997, 44515967, Reynolds Metals Company.

Reynolds Metal Company Drawing-Sections 57143, 100136-A, 100135-A, 57133, 57136-A.

*Primary Examiner*—Alfred C. Perham

*Attorney, Agent, or Firm*—Lyne, Girard & McDonald

[57] ABSTRACT

An extruded metal construction stud for use within a multitude of different interior room wall systems is disclosed as comprising a substantially U-shaped structure defined by means of a base web and a pair of perpendicular sidewalls. Each of the sidewalls is substantially S-shaped in configuration, and the corresponding parts thereof are reversed such that the sidewalls are, in effect, mirror-images of each other. Each of the sidewalls defines a pair of oppositely facing open channels integrally connected by means of a common flange. One of the channels is open to the exterior of the stud and accommodates edge portions of wall board panels. Flanges of the channels separate from the common flange serve to define support surfaces for wall board panels as do laterally outer portions of the sidewalls. The different wall systems are able to be expeditiously erected by incorporating one or more of the construction studs within the particular wall structure in a variety of different modes.

7 Claims, 8 Drawing Figures

METAL CONSTRUCTION STUD AND WALL SYSTEM INCORPORATING THE SAME

This application is a continuation of Ser. No. 930,392, filed Aug. 2, 1978.

FIELD OF THE INVENTION

The present invention relates generally to extruded metallic structural members, and structural systems incorporating the same, and more particularly to an extruded metallic wall stud, and a wall system employing a multitude of such studs in order to define interior wall, partition, and door structures.

BACKGROUND OF THE INVENTION

Within conventional residential and/or commercial establishments, various interior room structures are of course required to be erected. Such structures may take the form of, for example, interior room walls, interior room wall partitions, interior room closet partitions, interior room door frames, and the like. The support members comprising the framework for these various structures have, in the past, been wood studs, however, within recent years, metal stud extrusions have been employed.

In order to expedite the erection of the various interior room structures of the aforenoted types, a multitude of conventional metal stud extrusions have been fabricated, each extrusion having a specialized configuration which is specifically designed and adapted for the particular corresponding room structure being erected. As may well be appreciated, however, the fabrication of the numerous stud extrusions is quite costly in view of the tooling required for accomplishing the extrusion processes. In addition, confusion often occurs with respect to the selection of a particular extrusion at the job site when erecting one of the aforenoted room structures, in view of the fact that a particular extrusion may differ from another extrusion by means of a single flanged portion or other similar design characteristic.

OBJECTS OF THE INVENTION

Accordingly, it is an object of the present invention to provide a new and improved metal stud extrusion and a wall system incorporating the same.

Another object of the present invention is to provide a new and improved metal stud extrusion which will overcome the aforenoted disadvantages of conventional metal stud extrusions.

Still another object of the present invention is to provide a new and improved metal stud extrusion which will effectively replace a multitude of conventional metal stud extrusions, yet which will effectively serve the same support functions previously performed by the multitude of conventional extrusions.

Yet another object of the present invention is to provide a new and improved metal stud extrusion which will effectively replace a multitude of conventional metal stud extrusions and thereby substantially reduce tooling costs expended for fabricating the required metal stud extrusions.

A further object of the present invention is to provide a new and improved metal stud extrusion which will effectively replace a multitude of conventional metal stud extrusions and thereby substantially reduce the confusion occurring during interior room structure erection procedures employing such conventional metal extrusions.

A still further object of the present invention is to provide a new and improved metal stud extrusion which will greatly simplify interior room structure erection procedures.

A yet further object of the present invention is to provide a new and improved interior wall system which may be expeditiously erected at cost levels substantially below those characteristic of conventional wall systems.

SUMMARY OF THE INVENTION

The foregoing and other objectives are achieved in accordance with the present invention through the provision of an extruded metal construction stud which comprises a substantially U-shaped structure defined by a pair of opposed sidewalls and an integral web base connecting the sidewalls together. Each of the sidewalls is substantially S-shaped in configuration with corresponding parts thereof being reversed such that the sidewalls are, in effect, mirror-images of each other.

Each of the sidewalls defines a pair of oppositely facing open channels which are integrally connected together by means of a common flange, one of the channels being open to the interior of the stud while the other one of the channels is open to the exterior of the stud. The flanges of the channels which are separate from the common flange serve to define exterior support walls or surfaces upon which masonry or wall board materials may be supported or mounted, and the laterally outer portions of the sidewalls, disposed in planes perpendicular to the planes of the flanges, likewise serve to define additional exterior support surfaces for wall board materials. In addition, the exteriorly open channels also serve to define longitudinal grooves for accommodating the edge portions of wall board members or panels.

The foregoing structural characteristics of the construction stud of the present invention provide the same with a unique degree of versatility which permits the stud to be utilized in a variety of modes when incorporated within a wall system. In particular, for example, the stud may be utilized for erecting interior wall surfaces, interior wall partitions, interior closet partitions, interior room door frames, and the like. It is also to be noted that in forming wall partitions, for example, the web base of the stud may be disposed parallel to the wall board materials, or perpendicular thereto, whereby the partitions may have a selectively larger or narrower thickness as desired or required.

BRIEF DESCRIPTION OF THE DRAWINGS

Various other objects, features, and attendant advantages of the present invention will be more fully appreciated as the same becomes better understood from the following detailed description when considered in conjunction with the accompanying drawings, in which like reference characters designate like or corresponding parts throughout the several views, and wherein.

DETAILED DESCRIPTION OF THE ILLUSTRATED EMBODIMENTS

Figure 1:
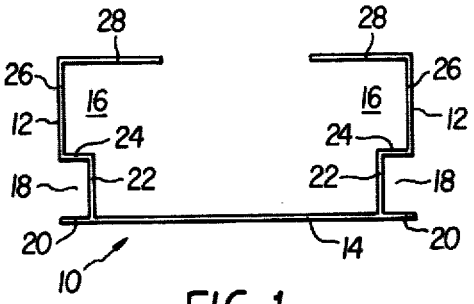
FIG. 1 is an end elevation view of the extruded construction stud constructed in accordance with the present invention and showing its cooperative parts.

Referring now to the drawings, and more particularly to FIG. 1 thereof, the construction stud of the present invention is shown and is generally indicated by the reference character 10. The stud, formed as an extrusion and preferably fabricated of aluminum metal, is utilized, for example, within interior residential and/or commercial establishments, in lieu of conventional wood or metal studs. As seen in the FIGURE, the stud of the present invention has a generally U-shaped configuration comprising a pair of sidewalls 12 and a web base 14 integrally connecting the sidewalls together. Each of the sidewalls 12 has a substantially S-shaped configuration with the corresponding parts thereof being reversed such that the sidewalls are, in effect, mirror-images of each other.

The aforenoted configuration of each sidewall 12 serves to define a pair of oppositely facing open channels, one of the channels 16 being open to the interior of the stud while the other one of the channels 18 is open to the exterior of the stud. The exterior channel 18 is defined by means of a base flange 20, which is co-planar with base web 14, a laterally inner sidewall portion 22 extending perpendicular to flange 20, and a central flange 24. In a similar fashion, the interior channel 16 is defined by means of central, common flange 24, a laterally outer sidewall portion 26 extending perpendicular to flange 24, and an inwardly facing flange 28 which is disposed parallel to flanges 20 and 24 and base web 14.

As will become apparent hereinafter, the co-planar relationship defined between base web 14 and base flanges 20 serves to define an exterior support wall or surface upon which masonry or wall board materials may be supported or mounted. In a similar fashion, it is noted that the lateral dimensions of flanges 28 are substantially greater than those of common flanges 24, and in this manner, the flanges 28 also serve to define an exterior support wall or surface for the masonry or wall board materials. Still further, the laterally outer sidewall portions 26 also serve as exterior support walls or surfaces for the masonry or wall board materials, and it is noted that the base flanges 20 do not extend laterally beyond the planes of sidewall portions 26 so as not to interfere with the support function of the sidewall portions 26. In conjunction with sidewall portions 26, it will also become apparent hereinafter that channels 18 define longitudinal grooves within which edge portions of masonry or wall board material panels may be disposed when, for example, constructing interior room wall corner structures.

In order that the unique versatility of the construction stud of the present invention may be truly appreciated and better understood, the following examples of wall systems and structures employing the construction stud of the present invention in a diversity of structural modes are disclosed. It is to be noted, however, that such exemplary systems and structures are merely for purposes of illustration, and the utility of the construction stud of the present invention is not to be deemed limited thereby.

EXAMPLE 1

Figure 2:
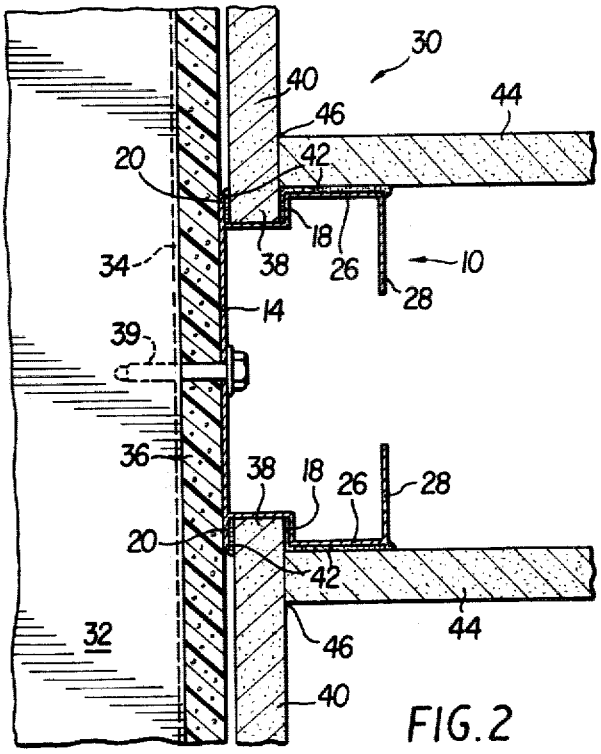
FIG. 2 is a horizontal cross-sectional view of a wall system employing the construction stud of FIG. 1 in order to erect interior room walls and interior room partition walls in conjunction with exterior wall support structure.

With particular reference now being made to FIG. 2, there is disclosed a wall system, generally indicated by the reference character 30, which employs the construction stud 10 in order to erect interior room walls and interior room partition walls in conjunction with exterior wall support structures. The exterior wall structure of the particular edifice may conventionally comprise a top plate or stringer 32, as well as a lower sill or stringer, not shown, which are disposed about the periphery of the edifice so as to define room structures. The top plate 32 has a dependent flange 34, with the lower sill having similar flange structure, to which suitable insulation board material 36, such as, for example, urethane or the like, is affixed. The construction stud 10 of the present invention may then be secured to the insulation board material 36, as well as to the top plate and bottom sill members, by means of suitable fasteners 39.

As will be particularly noted, the stud 10 is affixed to the exterior wall structure by means of its base web 14 being flushly mounted upon the insulation board 36. This permits the base flanges 20 to be disposed parallel to, and supported upon, board 36 as well. As a result, when the edge portions 38 of interior masonry or wall board members 40 are disposed within the oppositely facing channels 18 of stud 10, the wall board members 40 are properly supported upon, and disposed parallel to, the exterior wall structure comprising the stringers and insulation board 36, so as to define the interior room walls.

The wall board members 40 may be fabricated, for example, as pre-finished vinyl faced or coated gypsum board which does not require any painting, and the same may be readily secured within the stud channels 18 by means of a suitable adhesive 42. In order to complete the particular wall system of FIG. 2 whereby an interior room partition wall is erected in conjunction with the interior room walls, additional wall board members 44 may be secured to the outer sidewall portions 26 of stud 10 by means of adhesive 42. The partition wall members 44 are of course abutted against interior wall members 40 so as to define finished interior wall corners 46.

Figure 3A:
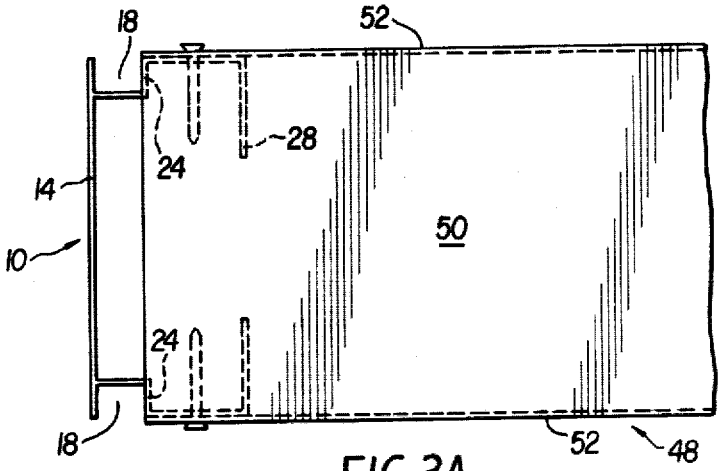
FIG. 3A is a plan view of the construction stud shown in FIG. 2 showing the interconnection of the stud to an interior partition wall stringer.
Figure 3B:
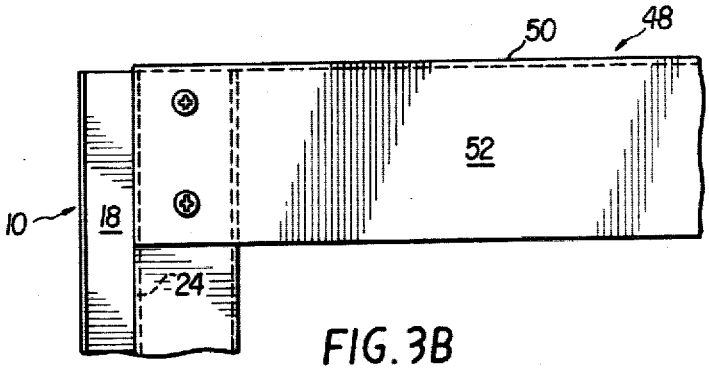
FIG. 3B is a side elevation view of the stud-stringer assembly of FIG. 3A.

When constructing the interior room partition walls, upper and lower stringers or plates must of course be provided in order to furnish proper support for the studs as shown for example within the system of FIG. 2. As shown in FIGS. 3A and 3B, the upper stringer, generally indicated by the reference character 48, has a simple U-shaped configuration comprising a base web 50 with dependent side walls 52. The lower stringer, not shown, has a similar configuration, and both stringers may be metal extrusions preferably fabricated of aluminum. It is to be noted that when securing the studs 10 interiorly of the channel type stringers 48 at the junction defined by the interior room walls and interior room partition walls as shown in FIG. 2, the studs 10 and stringers 48 must be secured together in the manner shown in FIGS. 3A and 3B. In particular, the stringer 48 cannot extend longitudinally beyond common central flange 24 so as not to block channels 18 and prevent the insertion of wall board members 40 thereinto.

EXAMPLE 2

Figure 4:
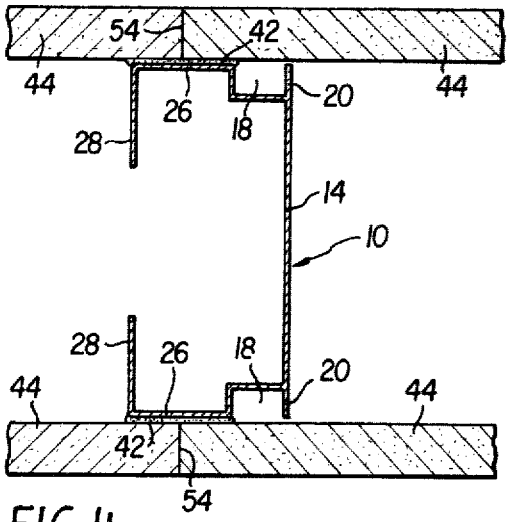
FIG. 4 is a horizontal cross-sectional view of a wall system employing the construction stud of FIG. 1 in order to erect interior room partition walls.

During erection of the interior room partition wall comprising partition wall members 44 as shown in FIG. 2, it will probably be necessary to provide for co-planar joint connections between succeeding members 44 as the length of the partition wall will in most instances be greater than the width of a conventional panel or wall member 44. Such co-planar joint connections may be achieved in accordance with the present invention as disclosed in FIG. 4. While the stud 10 is shown reversed in position from that of the stud 10 shown in FIG. 2, the position of the stud 10 within the system of FIG. 4 may be reversed so as to match the disposition shown in FIG. 2, the only requirement being that the base web 14 be disposed perpendicularly with respect to the planes of wall panels 44 so as to maintain the thickness or width of the partition wall constant.

In effecting the panel joint connections, it is seen that the stud 10 is positioned relative to the panels 44 to be jointed such that the joint situs 54 of each pair of panels 44 is located substantially centrally of the laterally outer sidewall portions 26 of the stud 10. As was the case of securing the partition wall panels 44 to stud 10 as shown in FIG. 2, the panels 44 of the joint connection are secured to stud 10 by means of suitable adhesive 42. As noted hereinbefore, it is seen that the base flanges 20 of stud 10 do not project beyond the planes of sidewall portions 26 so as not to interfere with the panel support functions of the sidewalls 26.

EXAMPLE 3

Figure 5:
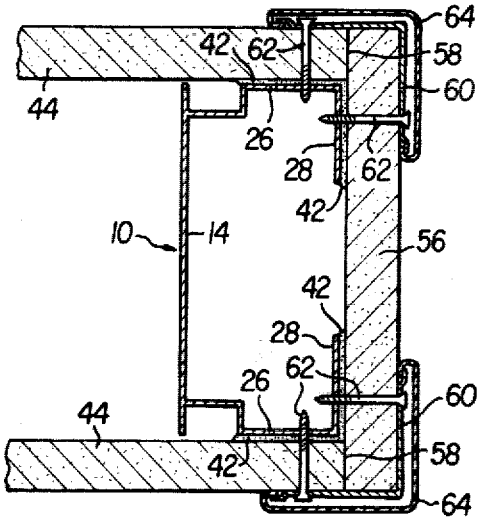
FIG. 5 is a horizontal cross-sectional view of a wall system employing the construction stud of FIG. 1 in order to erect an interior room closet partition wall.

An interior room partition wall is often constructed in order to partially define a closet enclosure as shown in FIG. 5. In constructing such an enclosure wall, when the particular extent of the partition wall has been determined, a third partition wall panel 56 is secured to the wall panels 44 defining the partition wall of FIG. 4. The third panel 56 is disposed perpendicular to the panels 44, and the length of panel 56 is equal to the outside thickness of the partition wall so as to form the joint sites 58. The construction stud 10 of the present invention is disposed in a manner similar to its disposition within the system of FIG. 4, that is, with the base web 14 perpendicular to the partition wall panels 44. In addition, the stud is positioned relative to the end of the partition wall defined by the ends of panels 44 such that the inwardly facing flanges 28 will be able to support the end panel 56. The laterally outer sidewall portions 26 serve to support the partition panels 44 in a manner similar to that shown in FIG. 4, and the panels 44 and 56 are of course secured to the stud 10 by means of suitable adhesive 42.

In order to impart a finished appearance to the closet enclosure wall, conventional corner brackets 60 may be secured to the corners of the partition enclosure wall, defined by wall panels 44 and 56, by means of suitable fasteners 62 which pass through the panels 44 and 56 as well as through the stud sidewall portions 26 and the stud flanges 28. Finished corner moldings 64, which may be fabricated of a suitable plastic material, may then be snapped onto the brackets 60 in a conventional manner.

EXAMPLE 4

Figure 6:
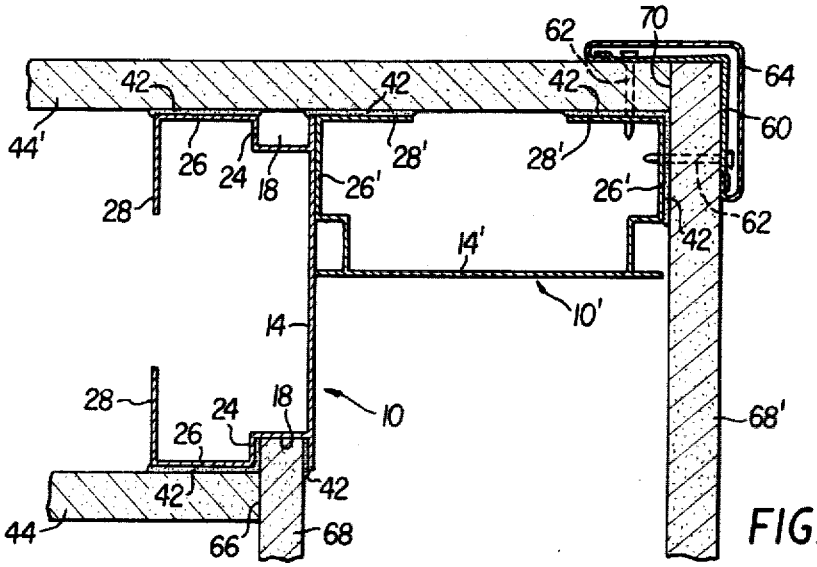
FIG. 6 is a horizontal cross-sectional view of a wall system employing a plurality of construction studs shown in FIG. 1 in order to erect interior room partition wall corner structures.

During construction of individual interior rooms, it is of course imperative to be able to erect corner structures defined between adjacent walls of the room with the included angle conventionally being, for example, 90°. In order to simply erect corner structures utilizing the construction stud of the present invention, a pair of studs 10 and 10' may be relatively disposed as seen in FIG. 6. The first stud 10 is disposed in a manner similar to the disposition of the stud in forming the joint connection of FIG. 4 whereby the base web 14 and the inwardly facing flanges 28 are perpendicular to the partition wall panels. It is to be noted from the FIGURE that the lower partition wall panel 44, as viewed in the FIGURE, will serve to partially define an interior corner of a particular room of the edifice, while the upper partition wall panel 44', as viewed in the FIGURE, will serve to partially define an exterior corner of another room of the edifice.

The stud 10 is positioned relative to wall panel 44 such that the central common flanges 24 are substantially coplanar with the end face or edge 66 of panel 44. This will permit the channel 18 adjacent panel 44 to be freely accessible in order to accommodate another wall panel 68 which will then be perpendicular to panel 44 and serve to define the interior corner therewith. The stud 10 is of course secured to panels 44 and 44' by means of adhesive 42, and panel 68 is likewise secured within channel 18.

The second stud 10' is seen to be disposed perpendicular to stud 10 such that the left, laterally outer sidewall portion 26', as viewed in the FIGURE, flushly contacts the base web 14 of stud 10. Furthermore, the inwardly facing flanges 28' of stud 10' are substantially co-planar with the upper, laterally outer sidewall portion 26 of stud 10. In this manner, the stud 10' will be flushly mounted upon the upper wall panel 44' and may be fixedly secured thereto by means of adhesive 42.

It is to be appreciated that when forming the aforenoted interior-exterior corner structure, the upper panel 44' will of course extend beyond the extent of lower panel 44 in order to accommodate the second stud 10' and determine, along with stud 10', the thickness of the adjacent room partition wall partially defined by panel 68. In particular, the extent of panel 44' is determined such that the end face or edge 70 is substantially co-planar with the right, laterally outer sidewall portion 26' of stud 10'. In this manner, a second panel 68' may be abutted against edge 70 of panel 44' and flushly supported upon sidewall portion 26' of stud 10' so as to extend parallel to panel 68 and thereby define the adjacent partition wall therewith. Of course, if it is so desired or required, for example, in view of space limitations, the thickness of the partition wall defined by means of panels 68 and 68' may be reduced from that shown in FIG. 6 by altering the position of stud 10'. In particular, stud 10' may be alternatively disposed in a parallel, back-to-back mode with respect to stud 10 wherein the base web 14' of stud 10' would be in contact with the base web 14 of stud 10. The thickness of the partition wall would then be determined by the dimension distance defined between the base web 14' and the inwardly facing flanges 28' of stud 10'.

Panel 68' may of course be secured to sidewall portion 26' by means of adhesive 42, and as noted hereinbefore, panel 68' serves to define an exterior room corner along with panel 44'. As was the case with the closet enclosure of FIG. 5, in order to impart a finished appearance to the exterior corner structure, corner molding brackets 60 may be secured to the panels 44' and 68', as well as to stud 10', by means of fasteners 62, and a corner molding 64 subsequently snapped thereon.

EXAMPLE 5

Figure 7:
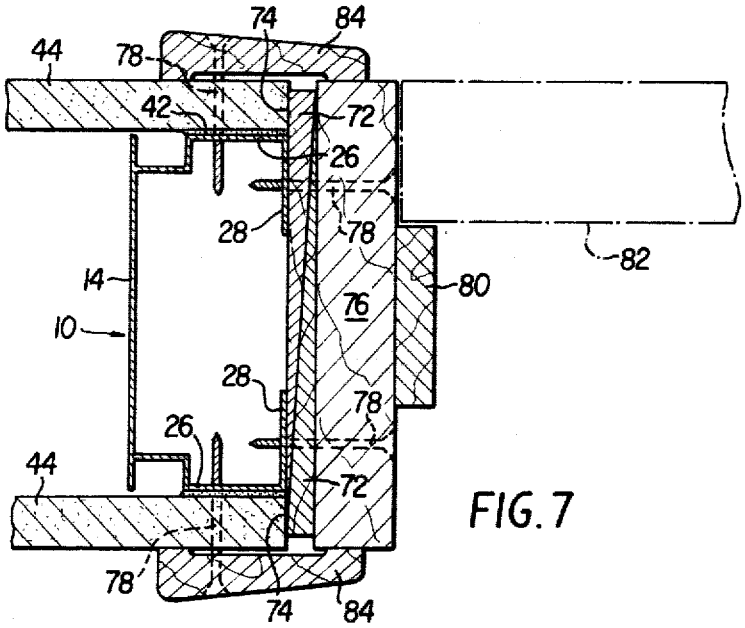
FIG. 7 is a horizontal cross-sectional view of a wall system employing the construction stud of FIG. 1 in order to erect an interior door frame structure.

As a last example of the unique versatility of the construction stud of the present invention, and of the diversity of wall systems which may be erected by incorporating the construction stud of the present invention therewithin, reference is now made to FIG. 7 wherein an interior door frame structure is shown. Within such a system, it is seen that the relative disposition of the stud 10 and the partition wall panels 44 is the same as that characteristic of the closet enclosure of FIG. 5. In lieu of end panel 56, however, the interior door frame structure comprises spacer shims 72 in abutting contact with the end faces or edges 74 of panels 44 and with the inwardly facing flanges 28 of stud 10. A door jamb 76 is supported upon the shims 72, and the jamb-shims assembly may be fixedly secured to stud 10 by means of fasteners 78.

The door jamb 76 is of course provided with a conventional door stop panel 80 which determines the closed position of the door closure 82, and in order to impart a finished appearance to the door frame structure, suitable door trim panels 84 may be fixedly secured to opposite sides of the partition wall-door jamb assembly by means of additional fasteners 78 which pass through the sidewall portions 26 of stud 10.

Thus, it may be seen that the construction stud of the present invention has important advantages over known prior art construction studs in that the unique versatility of the stud permits the same to be utilized within a diversity of modes in order to expeditiously effect the erection of various wall systems characteristic of interior room structures. The single type of construction stud characteristic of the present invention is able to effectively replace a multitude of varying types of prior art construction studs within the required wall systems, as a result of which, tooling costs for building stud materials are able to be substantially reduced. Confusion as to the selection of a particular stud for a specific interior room wall system or structure is greatly minimized, as a result of which, the wall systems are able to be erected in substantially less time. Consequently, in addition to the reduced cost of materials, additional savings in labor expenditures are also achieved.

Obviously, many modifications and variations are possible in light of the foregoing teachings. It is therefore to be understood that within the scope of the appended claims, the present invention may be practiced otherwise than as specifically described herein.

What is new and desired to be secured by Letters Patent of the United States is:

1. A one-piece, semi-hollow extruded metal construction stud, said stud comprising a pair of opposed sidewalls in parallel spaced relationship, each of said sidewalls comprising a pair of oppositely facing, open channels, said oppositely facing, open channels of each sidewall sharing a common flange, one of said oppositely facing, open channels of each sidewall being open to the interior of said stud and combining with the corresponding channel of the other sidewall open to the interior of said stud to form a common channel and the other of said oppositely facing, open channels of each sidewall being open to the exterior of said stud to form a pair of oppositely facing, co-planar channels, a flange apart from and parallel to said common flange for each of said channels open to the interior of said stud, said flanges apart from and parallel to said common flange for each of said channels open to the interior of said stud being in co-planar relationship and combining to define a first substantially flat exterior wall of said stud, a flange attached to and perpendicular to said common flange for each of said channels open to the interior of said stud, said flanges attached to and perpendicular to said common flange for each of said channels open to the interior of said stud defining a second and a third substantially flat exterior wall of said stud respectively, the interior of said oppositely facing channels open to the exterior of said stud each defining a groove adapted to receive a straight-cut edge of a piece of construction board or the like, each of said sidewalls being arranged with respect to the other such that said stud is symmetrical about a centerline between said sidewalls, a central web integral with and extending between said sidewalls for connecting said sidewalls together, said web extending between said oppositely facing channels open to the exterior of said stud, and a flange apart from and parallel to said common flange for each of said channels open to the exterior of said stud, said web and said flanges apart from and parallel to said common flange for each of said channels open to the exterior of said stud being integral and in co-planar relationship and combining to define a fourth substantially flat exterior wall of said stud.

2. A wall system within an edifice comprising at least one one-piece, semi-hollow extruded metal construction stud, said stud comprising a pair of opposed sidewalls in parallel spaced relationship, each of said sidewalls a pair of oppositely facing, open channels, said oppositely facing, open channels of each sidewall sharing a common flange, one of said oppositely facing, open channels of each sidewall being open to the interior of said stud and combining with the corresponding channel of the other sidewall open to the interior of said stud to form a common channel and the other of said oppositely facing, open channels of each sidewall being open to the exterior of said stud to form a pair of oppositely facing, co-planar channels, a flange apart from and parallel to said common flange for each of said channels open to the interior of said stud, said flanges apart from and parallel to said common flange for each of said channels open to the interior of said stud being in co-planar relationship and combining to define a first substantially flat exterior wall of said stud, a flange attached to and perpendicular to said common flange for each of said channels open to the interior of said stud, said flanges attached to and perpendicular to said common flange for each of said channels open to the interior of said stud defining a second and a third substantially flat exterior wall of said stud respectively, the interior of said oppositely facing channels open to the exterior of said stud each defining a groove adapted to receive a straight-cut edge of a piece of construction board or the like, each of said sidewalls being arranged with respect to the other such that said stud is symmetrical about a centerline between said sidewalls, a central web integral with and extending between said sidewalls for connecting said sidewalls together, said web extending between said oppositely facing channels open to the exterior of said stud, and a flange apart from and parallel to said common flange for each of said channels open to the exterior of said stud, said web and said flanges apart from and parallel to said common flange for each of said channels open to the exterior of said stud being integral and in co-planar relationship and combining to define a forth substantially flat exterior wall of said stud.

3. The wall system of claim 2 further comprising exterior edifice wall means having said web mounted flushly thereon, interior wall means comprising a pair of wall board panels disposed within said grooves of said oppositely facing channels open to the exterior of said stud and interior partition wall means comprising a pair of wall board panels secured to said flanges attached to and perpendicular to said common flange for each of said channels open to the interior of said stud.

4. The wall system of claim 3 further comprising a second construction stud similar to said at least one construction stud, said second construction stud being disposed substantially parallel to said at least one construction stud so as to be interposed between said interior partition wall board panels, said flanges apart from and parallel to said common flange for each of said channels open to the interior of said second stud being disposed substantially co-planar with end faces of said interior partition wall board panels, and an end wall board panel supported upon said end faces of said partition wall board panels and said co-planar stud flanges so as to define a closet enclosure partition wall.

5. The wall system of claim 3 further comprising a second pair of interior partition wall board panels, each of said second pair of interior partition wall board panels being co-planarly jointed to a corresponding interior partition wall board panel of said pair of interior wall board panels, and a second construction stud similar to said at least one construction stud, said second construction stud being disposed substantially parallel to said at least one construction stud so as to be interposed between said pairs of partition wall board panels, the joint sites defined between said pairs of partition wall board panels being substantially centered relative to said flanges attached to and perpendicular to said common flange for each of said channels open to the interior of said second stud.

6. The wall system of claim 3 further comprising a second construction stud similar to said at least one construction stud, said second construction stud being disposed substantially parallel to said at least one construction stud so as to be interposed between said interior partition wall board panels, one of said partition wall board panels having an extent greater than the other one of said wall board panels, said second stud being positioned relative to said other one of said partition wall board panels such that one of said grooves of said oppositely facing channels open to the exterior of said second stud is freely accessible, a third construction stud similar to said at least one construction stud, said third construction stud being disposed substantially perpendicular to said second construction stud and having one of its flanges attached to and perpendicular to said common flange for each of said channels open to the interior of said third stud in contact with said fourth substantially flat exterior wall of said second construction stud, said third stud also being flushly mounted along its first substantially flat exterior wall upon said one of said partition wall board panels along said greater extent thereof, and a second pair of interior partion wall board panels, one of said second pair of interior partition wall board panels having an edge portion thereof disposed within said freely accessible exterior groove of said second construction stud, the other one of said second pair of interior partition wall board panels being mounted upon the end face of said one of said partition wall board panels having a greater extent and upon the other of said flanges attached to and perpendicular to said common flange for each of said channels open to the interior of said third stud, whereby an interior-exterior room corner structure is effected.

7. The wall system of claim 3 further comprising a second construction stud similar to said at least one construction stud, said second construction stud being disposed substantially parallel to said at least one construction stud so as to be interposed between said interior partition wall board panels, said flanges apart from and parallel to said common flange for each of said channels open to the interior of said second stud being disposed substantially co-planar with end faces of said interior partition wall board panels, and door frame means supported upon said end faces of said interior partition wall board panels, upon said co-planar stud flanges and upon said interior partition wall board panels, so as to define an interior door frame structure.

* * * * *